US008157481B1

(12) United States Patent
Doyle, Jr. et al.

(10) Patent No.: US 8,157,481 B1
(45) Date of Patent: Apr. 17, 2012

(54) METHOD FOR TEMPLATELESS FOUNDATION INSTALLATION

(75) Inventors: Earl Howard Doyle, Jr., Sugar Land, TX (US); David Armstrong Huete, Spring, TX (US); Richard Garside, Kenner, LA (US); Dale Richard Snyder, Houston, TX (US)

(73) Assignee: Shell Oil Company, Houston, TX (US)

( * ) Notice: Subject to any disclaimer, the term of this patent is extended or adjusted under 35 U.S.C. 154(b) by 3006 days.

(21) Appl. No.: 08/778,114

(22) Filed: Jan. 2, 1997

Related U.S. Application Data

(63) Continuation of application No. 08/236,295, filed on May 2, 1994, now abandoned.

(51) Int. Cl.
*E02D 13/00* (2006.01)

(52) U.S. Cl. ..... 405/228

(58) Field of Classification Search ..... 405/171, 405/172, 195.1, 196, 197, 200–208, 223.1, 405/224, 224.2, 224.1, 224.3, 224.4, 225–228, 405/249; 114/230.1, 230.13, 293, 294, 265
See application file for complete search history.

(56) References Cited

U.S. PATENT DOCUMENTS

| | | | | |
|---|---|---|---|---|
| 975,488 | A | | 11/1910 | Welsh |
| 2,274,082 | A | | 2/1942 | McCammon |
| 2,574,140 | A | | 11/1951 | Boschen |
| 2,651,181 | A | | 9/1953 | Alcron et al. |
| 2,736,172 | A | | 2/1956 | McChesney |
| 2,865,179 | A | | 12/1958 | McNeill |
| 2,959,016 | A | | 11/1960 | Parks |
| 3,138,932 | A | | 6/1964 | Kofahl et al. |
| 3,224,204 | A | | 12/1965 | Sieberhausen |
| 3,327,780 | A | * | 6/1967 | Knapp et al. ..... 405/224 X |
| 3,330,338 | A | * | 7/1967 | Dozier ..... 405/225 |
| 3,347,053 | A | | 10/1967 | Manning |
| 3,355,899 | A | | 12/1967 | Koonce et al. |
| 3,422,628 | A | | 1/1969 | McDonald |
| 3,496,728 | A | | 2/1970 | Slack |
| 3,512,811 | A | | 5/1970 | Bardgette et al. |
| 3,528,254 | A | | 9/1970 | Graham |
| 3,543,523 | A | | 12/1970 | Nelson |
| 3,592,012 | A | | 7/1971 | Mott |
| 3,648,638 | A | | 3/1972 | Blenkarn |
| 3,716,994 | A | | 2/1973 | Pogonowski |
| 3,745,774 | A | * | 7/1973 | Sharp ..... 405/225 |
| 3,756,033 | A | | 9/1973 | Kouka |

(Continued)

FOREIGN PATENT DOCUMENTS

DE 3137967 4/1983

(Continued)

OTHER PUBLICATIONS

Search Report of Aug. 23, 1995. *Offshore Magazine*, Aug. 1986, p. 19.
*Offshore Engineer*, Feb. 1985, all.
*Riles*, "The Pre-Installed Foundation Concept Jacket: A Case History" pub. at the Offshore Tech. Conf.. OTC 5639.

(Continued)

*Primary Examiner* — Sunil Singh

(57) ABSTRACT

A method of installing a foundation system for securing the tendons of a TLP to the ocean floor. The foundation system is installed in templateless operations in which a pile is secured to the ocean floor and a tendon receptacle is secured to the pile such that the load from a tendon secured therein is transferred to the ocean floor through coaxially aligned load paths of tendon-to-tendon receptacle-to-pile-to-ocean floor.

7 Claims, 5 Drawing Sheets

U.S. PATENT DOCUMENTS

| | | | | | |
|---|---|---|---|---|---|
| 3,805,534 | A | | 4/1974 | Brasted | |
| 3,934,658 | A | | 1/1976 | Nelson | 175/7 |
| 3,955,521 | A | | 5/1976 | Mott | |
| 3,998,064 | A | | 12/1976 | Jansz | 61/53.5 |
| 4,069,683 | A | | 1/1978 | Jansz | |
| 4,102,143 | A | | 7/1978 | Phares et al. | |
| 4,109,476 | A | | 8/1978 | Gracia | |
| 4,117,690 | A | | 10/1978 | Besse | 405/227 |
| 4,126,008 | A | | 11/1978 | Dixon | 405/207 |
| 4,138,199 | A | | 2/1979 | Gendron et al. | 405/232 |
| 4,147,036 | A | | 4/1979 | Worrell et al. | 405/205 |
| 4,180,349 | A | | 12/1979 | van Bilderbeek | 405/224 |
| 4,181,453 | A | | 1/1980 | Vacke | 405/203 |
| 4,260,291 | A | | 4/1981 | Young et al. | 405/205 |
| 4,320,993 | A | | 3/1982 | Hunter | 405/224 |
| 4,322,182 | A | | 3/1982 | Ostgaard | 405/227 |
| 4,339,899 | A | | 7/1982 | Klenk et al. | 52/157 |
| 4,344,721 | A | | 8/1982 | Goldsmith | 405/224 |
| 4,351,258 | A | | 9/1982 | Ray et al. | |
| 4,363,566 | A | | 12/1982 | Morton | 405/169 |
| 4,378,179 | A | | 3/1983 | Hasle | 405/227 |
| 4,388,024 | A | | 6/1983 | Dysarz | 405/198 |
| 4,413,926 | A | | 11/1983 | Ninet | 405/204 |
| 4,417,831 | A | | 11/1983 | Abbott et al. | 405/227 |
| 4,421,436 | A | * | 12/1983 | Burns | 405/223.1 |
| 4,421,438 | A | | 12/1983 | Abbott et al. | 405/227 |
| 4,426,173 | A | | 1/1984 | Richart et al. | 405/195 |
| 4,428,702 | A | | 1/1984 | Abbott et al. | 405/202 |
| 4,429,742 | A | | 2/1984 | Antes | 66/127 |
| 4,436,454 | A | | 3/1984 | Ninet et al. | 405/204 |
| 4,459,933 | A | | 7/1984 | Burchett | 114/297 |
| 4,468,157 | A | | 8/1984 | Horton | 405/224 |
| 4,471,709 | A | | 9/1984 | Chun | 114/293 |
| 4,505,620 | A | | 3/1985 | Andrier | 405/224 |
| 4,537,533 | A | | 8/1985 | Hampton | 405/227 |
| 4,540,314 | A | | 9/1985 | Falkner, Jr. | |
| 4,553,878 | A | | 11/1985 | Willemse et al. | 405/203 |
| 4,561,231 | A | | 12/1985 | Hoyt et al. | 52/297 |
| 4,611,953 | A | | 9/1986 | Owens | 405/224 |
| 4,669,918 | A | | 6/1987 | Riles | 405/227 |
| 4,684,292 | A | | 8/1987 | des Deserts et al. | 405/202 |
| 4,702,321 | A | | 10/1987 | Horton | 166/350 |
| 4,705,430 | A | | 11/1987 | Will | 405/227 |
| 4,733,993 | A | | 3/1988 | Andreasson | 405/224 |
| 4,784,529 | A | * | 11/1988 | Hunter | 405/224 |
| 4,907,914 | A | | 3/1990 | Gunderson et al. | 405/224 |
| 4,938,632 | A | * | 7/1990 | Eie | 405/223.1 |
| 4,943,188 | A | | 7/1990 | Peppel | 405/224 |
| 4,968,183 | A | | 11/1990 | Hannus et al. | 405/224 |
| 5,114,276 | A | | 5/1992 | Dupin | 405/224 |
| 5,117,914 | A | | 6/1992 | Blandford | 166/344 |
| 5,118,221 | A | | 6/1992 | Copple | 405/224.2 |
| 5,195,848 | A | * | 3/1993 | Huete et al. | 405/223.1 |
| 5,207,534 | A | * | 5/1993 | Brasted et al. | 405/223.1 |
| 5,275,511 | A | * | 1/1994 | Pelletier et al. | 405/227 |
| 5,324,141 | A | * | 6/1994 | Hunter et al. | 405/223.1 |
| 5,342,148 | A | * | 8/1994 | Huete et al. | 405/223.1 |
| 5,536,117 | A | | 7/1996 | Frame et al. | |

FOREIGN PATENT DOCUMENTS

| | | | | |
|---|---|---|---|---|
| EP | 054914 | | | 6/1982 |
| EP | 099938 | | | 7/1982 |
| EP | 059648 | | | 8/1982 |
| EP | 494 497 | A1 | | 7/1992 |
| EP | 640522 | A1 | | 3/1995 |
| EP | 0640522 | A1 | | 3/1995 |
| FR | 1389216 | | | 1/1965 |
| FR | 1468357 | | | 12/1966 |
| GB | 2044707 | | | 10/1980 |
| GB | 2054710 | A | | 2/1981 |
| GB | 2177744 | | * | 1/1987 |
| GB | 2178101 | A | | 4/1987 |
| GB | 2302119 | | | 1/1997 |
| NL | 6508158 | | | 12/1966 |
| NL | 6508158 | | | 1/1967 |
| SU | 1041393 | | | 12/1981 |

OTHER PUBLICATIONS

Tomlinson, M. J., "Foundation Design and Construction", 1986. pp. 699-703.

Hammond, "Modern Foundation Methods", pp. 162-172.

Tomlinson. "Pile Design and Construction Practice", 1977, pp. 72-75: 260-261.

Graham and Trotman, "Offshore Engineering: Development of Small Oilfields", 1986. pp. 79-87.

Dawson, "Offshore Structural Engineering", 1983, pp. 3-20, 233-263.

Walter, "Case Study on the Highlander Project", U.K. Offshore Conf.

*The Oilman*, "Texaco's Fast Track to Early Production", Aug. 1985, p. 27.

*Offshore Engineer*, "Scott's Firm Footing", Oct. 1992. p. 21.

*Offshore Engineer*, "Highlander Nears Subsea Completion", Feb. 1985. p. 27.

*Offshore Engineer*, "Higher Tech at Deeper Depth", Sep. 1985, p. 48.

Smith & Batchelor, *SPE Production Engineering*, "Overview of the Texaco Highlander Field Development", Nov. 1987, pp. 313-317.

Wheeler, "Overview of the Texaco Highlander Field Development", 6$^{th}$ SPE Offshore Southeast Asia Conf., Jan. 1986, pp. 18-24.

Holy & Frazier, "Fabrication, Recommissioning and Installation of the Highlander Subsea Facilities", Deep Offshore Tech. Conf., 1985, pp. 99-101.

Bea and Dover, *OTC 3749*, "Dynamic Response of Laterally and Axially Loaded Piles", May 1980, pp. 129-140.

Urbuhart, "Civil Engineering Handbook", 1959.

"Man the Builder", p. 166.

Encyclopedia Britannica, vol. 3.

Stubb's Handbook of Heavy Construction, 1959, pp. 23-5 to 23-6.

Baur & Clark, *OTC 4214*, "The First Docking Operation of a Large North Sea Platform Over a Subsea Template", May 1982, pp. 581-591.

Bradshaw, Barton & McKenzie, *OTC 4807*, "The Hutton TLP Foundation Design", May 1984, pp. 263-273.

Lenihan, Austin & Flanagan, *OTC 4759*, "The Rapid Installation of a Large North Sea Jacket Over a Subsea Template", May 1984, pp. 419-430.

Childers, Verhaak & Loth, *OTC 4608*, "UMC Design Review", May 1983, pp. 237-244.

Harrington & Williams, *OTC 4881*, "Inexpensive Casing Supported Drilling Templates", May 1985, pp. 47-54.

Bradshaw, Stokes & Leece, *OCT 4913*, "Hutton TLP Installation", May 1985, pp. 159-167.

Harrington & Williams, *OTC 4962*, "Deepwater Diverless Technology Applied to Shallow Water Operations in Hostile Environment", May 1985, pp. 47-54.

Brinkman, Barbier & Rodriguez, *OTC 5018*, "Design and Istallation of a 20-Slot Template in the Gulf of Mexico in 750 Ft. of Water", May 1985, pp. 501-508.

Noblanc & Schnader, *OTC 4571*, Precise Seabed Emplacement of an Articulated Loading Platform in the North Sea, May 1983, pp. 481-488.

Nelson, Murphy & Stahl, *OTC 4572*, "Bumper Pile Design for Mating and Subsea Drilling Template", May 1983, pp. 489-495.

Hart, White, von Fischer, *OTC 4910*, "Hutton TLP Marine Operations", May 1985, pp. 113-130.

Tokunaga, Tagaya, Kusaka & Ishii, *OTC 4882*, "Design and Construction of The World's First Rock-Anchored Jacket", May 1985, pp. 321-332.

Berthin, Hudson and Myrabo, *OTC 4876*, "Installation on Maureen Gravity Platform Over A Template", May 1985, pp. 321-332.

Tetlow & Leece, *OTC 4428*, "Hutton TLP Mooring System", May 1982, pp. 573-583.

"Thunder Bay", MCA Home Video, 1953.

W. G. Riles, "Jacket Re-Use Now Possible", Offshore, Jun. 1986, pp. 52-56.

"New Concept Isolates Template", Offshore Enginer, Jul. 1981, p. 66.

OTC 10919, "Installation of the Baldpate Compliant Tower", D. M. de Koeijer et al., May 1999, pp. 395-410.

"Regular Features", Offshore Engineer, Feb. 1985, pp. 27, 73-76, 80, 83, 84-98.

"Subsea Business Recovers from Financial Depths", Offshore Engineer, Feb. 1985, pp. 34-35.

"Southern Basin Busy—Sean Jackets Set to Meek Peak Demand", Offshore Engineer, Feb. 1985, pp. 52-53.

"3D Seismic Proves its Worth in Cormorant Remodelling", Offshore Engineer, Feb. 1985, pp. 61, 62,64.

"Floating Highlander", Offshore Engineer, Feb. 1985, p. 31.

"Business in Focus", Offshore Engineer, Feb. 1985, p. 29.

"Heavy Lift Battle Hots Up as Contractors Switch Tactics", Offshore Engineer, Feb. 1985, pp. 15-27.

"World in Focus", Offshore Engineer, Feb. 1985, pp. 9-10.

"UK Offshore—Maintaining Self-Sufficiency—Paper 10. Case study on the Highlander Project", Thomas Telford.

"Fabrication, Precommissioning and Installation of the Highlander Subsea Facilities", Grant Holy and Ronald Frazier, Deep Offshore Technology. Conf. 1985.pp. 91-106.

* cited by examiner

METHOD FOR TEMPLATELESS FOUNDATION INSTALLATION

This is a continuation of application Ser. No. 08/236,295 filed May 2, 1994, Now Abandoned.

BACKGROUND OF THE INVENTION

The present invention relates to deepwater platform foundations. More particularly, it relates to a tension leg platform foundation anchored to the ocean floor through a plurality of piles.

As used herein, a "tension leg platform" or TLP refers to any buoyant structure tethered to the ocean floor through substantially vertical tendons tensioned to draw the buoyant structure below its normal floating draft. Various embodiments include a full scale TLP having full drilling facilities, a tension leg well platform ("TLWP") having only a scaled down "completion" rig, a tension leg well jacket ("TLWJ") designed to accept well operations from an auxiliary vessel, or any other tendon deploying variation.

Tendons connect the buoyant hull to a foundation system at the ocean floor and are tensioned to draw the buoyant hull below its normal floating draft. The tendons transmit this static load to the foundation system. Further, the tendons must transmit this static load while subject to additional loads which have significant cyclical components driven by environmental forces of wind, wave and current on the hull and tendons. The combined load is transmitted to the ocean floor through the foundation system.

Some early designs for vertically moored platform concepts contemplated using the same tubular members simultaneously for the structural mooring elements and for the risers through which drilling and production operations were to be conducted. However, this was found to be impractical due to both operational constraints and the risks, difficulties, and expense of designing the tubular goods for the internal pressure in these members as flowlines and the axial load as mooring members. Thus, in application, the designs have developed with separate risers and tendons.

The bottoms of the tendons are secured to a foundation system at tendon receiving load connections or tendon receptacles. In traditional practice, the foundation system is built around a foundation template. The template is a framework which permanently interconnects the tendon receptacles and the pile sleeves. Vertical (surface) access of tendons and piles to tendon receptacles and pile sleeves, respectively, is provided by a horizontal offset therebetween in their position on the template.

In the conventional practice, the foundation template is placed and the piles are installed through the pile sleeves and set deeply into the sediment at the ocean floor. The piles are then secured to the pile sleeves and the foundation template is ready to accept tendons.

The foundation template serves two purposes in such a foundation system. First, it provides spacing and modular placement of the pile sleeves, the tendon receptacles, and often a plurality of well guides. Second, the template is a permanent fixture providing load bearing interconnection between piles anchored to the ocean floor and tendon receptacles.

However, the tendon-to-receptacle, to-template (and over)-to pile sleeve, to-pile, to-ocean floor load path of the conventional template based foundation system is an inefficient load transfer scheme. This also commits a large quantity of steel to the template and creates handling difficulties for transporting and deploying the massive template. Further, the lateral spacing between the tendon receptacles and the pile sleeves which introduces these inefficiencies also exacerbates the fatigue response of the template based foundation system.

A plurality of smaller corner templates have been used in designs which provide well guides outside of the template as an alternative to a unitary template which includes well guides. This does reduce the material requirements, but does not alleviate the inefficiencies in load transfer discussed above.

Thus, there remains a clear need for a TLP foundation system which provides an improved and more direct load transfer between tendons and the ocean floor.

SUMMARY OF THE INVENTION

Towards the fulfillment of this and other objects, the present invention is a method for installing a foundation system for securing the tendons of a TLP to the ocean floor. The foundation system is installed in templateless operations in which a pile is secured to the ocean floor and a tendon receptacle is secured to the pile such that the load from a tendon secured therein is transferred to the ocean floor through coaxially aligned load paths of tendon-to-tendon receptacle-to-pile-to-ocean floor.

Other aspect of the present invention include an improved pile having an interior load shoulder positioned below a tendon load connection such that the direct blows of an underwater hammer through a follower to the interior load shoulder bypasses the tendon load connection.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which.

A DETAILED DESCRIPTION OF THE PREFERRED EMBODIMENT

Figure 1A:
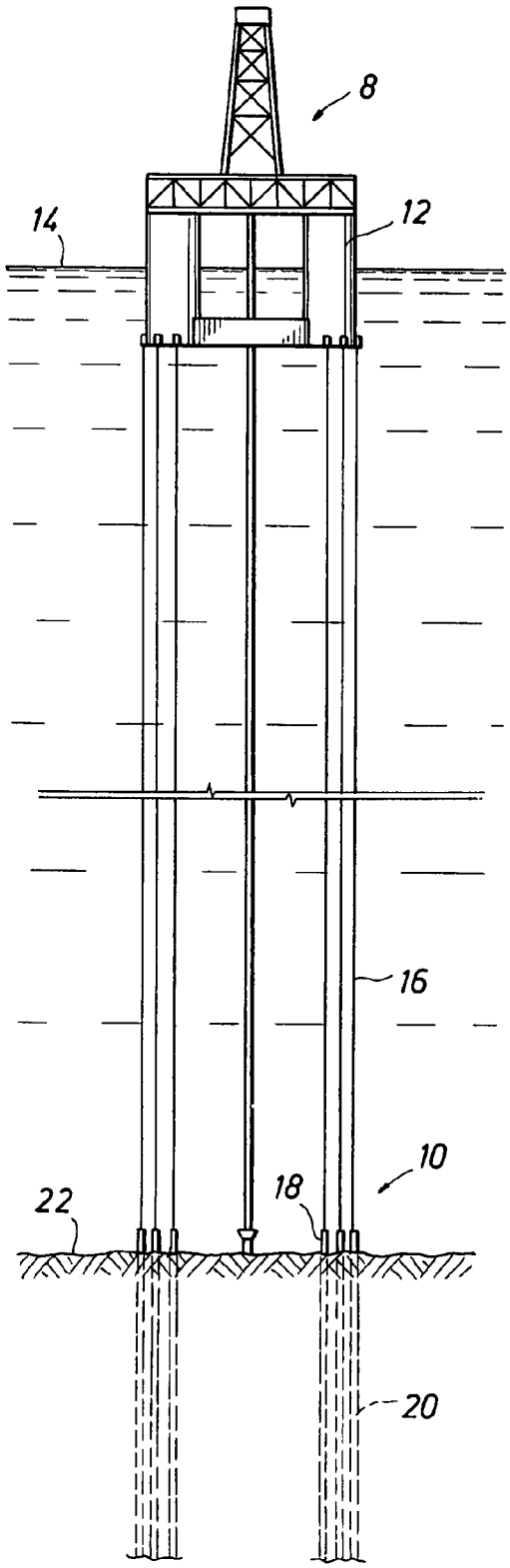
FIG. 1A is a side elevational view of a TLP deploying one embodiment of a foundation system in accordance with the present invention.

FIG. 1A generally illustrates a TLP 8 having buoyant hull 12 riding on ocean surface 14 and tethered in place about tendons 16 secured to the foundation system 10 of the present invention. Foundation system 10 includes tendon receptacles 18 into which the bottom of tendons 16 are secured and piles 20 which extend deep into ocean floor 22.

Figure 1B:
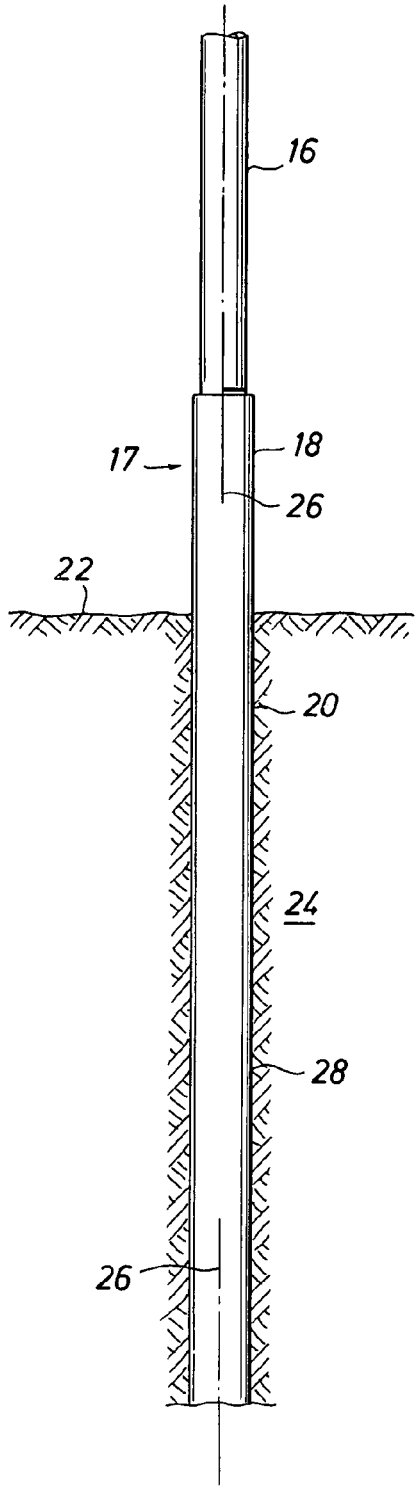
FIG. 1B is a side elevational view of one of the members of the foundation system of FIG. 1A.

FIG. 1B is a more detailed illustration of one of tendons 16 latched into a tendon receiving load connection 17, here in the form of tendon receptacle 18, provided on pile 20. In this embodiment, pile 20 combines an elongated cylindrical member or pile member 28 with an integrally formed tendon receptacle 18. Elongated cylindrical member 28 extends deeply into sediment 24 at ocean floor 22 to such a depth as which the skin friction between the sediment and the exterior of the pile is competent to securely restrain, with an adequate margin of safety, the axial load of restraining buoyant hull 12 of TLP 8 in place and drawn below its natural buoyant draft through tendon 16. See FIG. 1A.

Returning to FIG. 1B, foundation system 10 is shown to have a load path through the tendon-to-tendon receptacle-to-pile which is coaxial about axis 26 from the tendon to interaction with the sediment at the ocean floor. This alignment of tension receptacles and piles facilitates loading in tension without transmission as a bending moment laterally over to a foundation template, and from there as a bending moment across a connection to a pile sleeve.

Figure 2A:
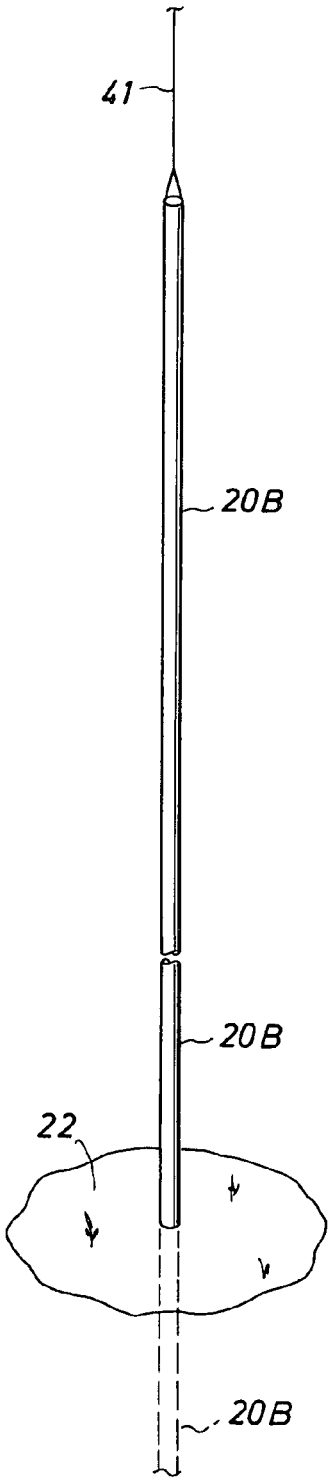
FIG. 2A is a perspective view of an installation of the foundation system in accordance with one embodiment of the present invention with a pile advancing through a first interval.
Figure 2B:
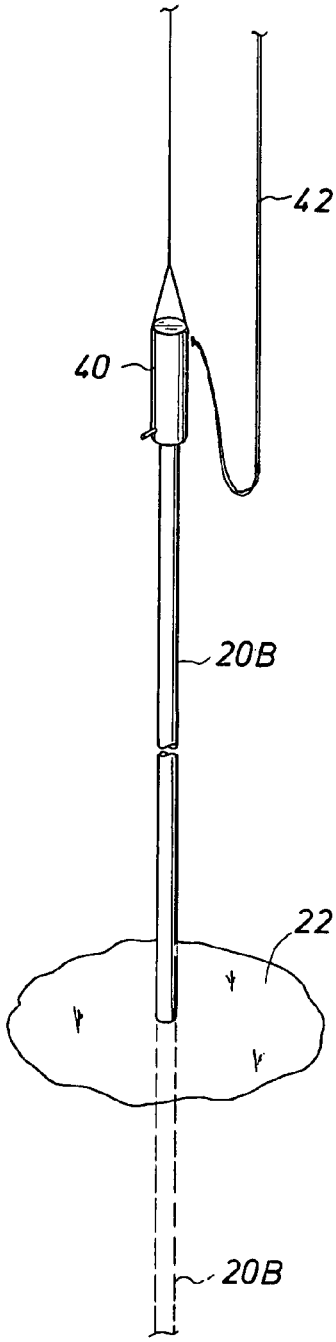
FIG. 2B is a perspective view of an installation of the foundation system of the with the advancement of the pile of FIG. 2B through a third or final interval in accordance with an embodiment of the present invention.

FIGS. 2A and 2B illustrate one embodiment for the method of installation of foundation system 10 on ocean floor 22. These Figures disclose an embodiment of a method of free-standing installation in which no template is deployed, temporarily or otherwise.

FIG. 2A illustrate the first step of this embodiment of templateless installation. Pile 20B is lowered on cable 41 from a crane or draw works on the surface. The bottom of pile 20B reaches ocean floor 22 to setdown and penetrates the first interval of the sediment, driven by the weight of the pile itself as alignment and position continue to be controlled through the cable. Acoustic or other reference aids are used to secure position for touchdown. However, careful cable control remains very important for the advancing pile throughout the initial interval such that the rate of feed does not exceed the rate of penetration. The setdown and the orientation (controlled by rate of feed) are the only guiding mechanism absent template secured pile sleeves which are an integral part of the conventional installation.

The pile becomes self supporting after an initial interval and it is no longer necessary to maintain alignment of pile 20B with cable 41. The pile is then self guiding through the second interval to "refusal" at the full depth of self penetration.

Cable 41 is released from its connection to the pile and a pile hammer 40 is then deployed to continue driving pile 20B to a secure depth competent to restrain the tendon loads. See FIG. 2B. Vertical blows to a load or drive surface at the top of the pile or other load surface drives the lower end of the pile deeper and deeper into the sediment. Underwater hammer 40 is removed after the pile has been driven to design depth. At this point, the pile will accept a tension load, but the pile will continue to "set" over a period of time following installation during which period the load bearing capacity of the pile increases as the sediment compacts about the pile.

It is common in the art to refer to driving piles "to refusal" at which point the skin friction and penetration resistance diminishes the rate of penetration. However, the "refusal" is diminished penetration, advance is not totally stopped, and it remains practical in many applications to design for horizontal alignment of the tops of piles 20. For instance, the tendon receptacles 18 are formed integrally with piles 20 in FIG. 2A. In this embodiment it is preferred for tendon receptacles 18 to be presented in a single horizontal plane and this can be achieved through careful driving operations.

Pile deployment designs for a large scale TLP for selected seabed sediments in the Gulf of Mexico were recently calculated based on a 84 inch diameter, 1.125 to 1.75 inch wall thickness pile and found to be self-supporting in 50-60 feet and self penetrating to 100-120 feet of a total 355 foot drive depth.

FIGS. 3A-3E illustrate a sampling of embodiments of the present invention. These are each illustrated with guide surfaces inside tendon receptacles 18 suitable to cooperate with a rotating lug tendon anchor assembly 52 (see FIG. 4). However, those having ordinary skill in the art will appreciate that any number of hydraulic or mechanical latching mechanisms or other connection systems may be used in the practice of the present invention.

Figure 3A:
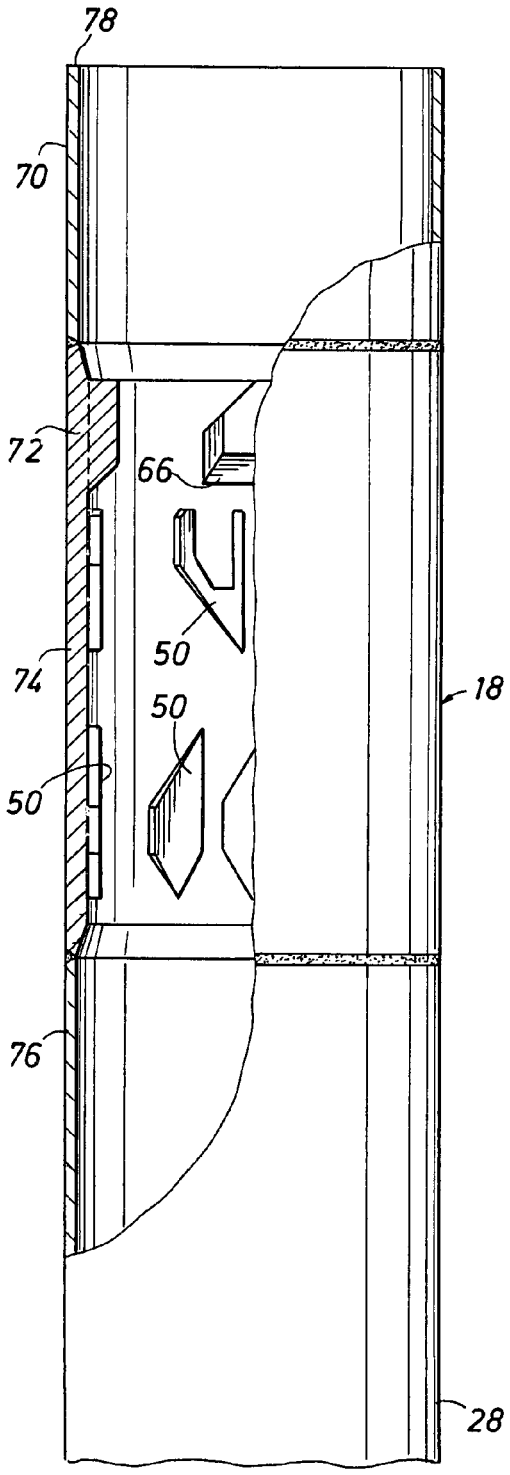
FIG. 3A is a partially cross-sectioned view of a pile having an integral tendon receptacle

FIG. 3A illustrates an embodiment of pile 20 in which tendon receptacle 18 is formed integrally with elongated cylindrical member 28. Here the upper end of pile 20 includes a drive head 70, a load ring 72, a receptacle body 74 and a transition section 76. The drive head accepts an externally mounted underwater hammer and presents drive surface 78 through which hammer blows are delivered to drive the pile. It is preferred that the walls of drive head 70 be thickened to protect against deformation during driving operations. Receptacle body 74 is also strengthened with a thicker wall in this embodiment to transmit the force of the hammer while protecting the dimensional integrity of guide surfaces 50 and protecting against metal fatigue. Transition section 76 reduces stress concentration in narrowing this wall thickness to that of elongated cylindrical member 28.

Figure 3B:
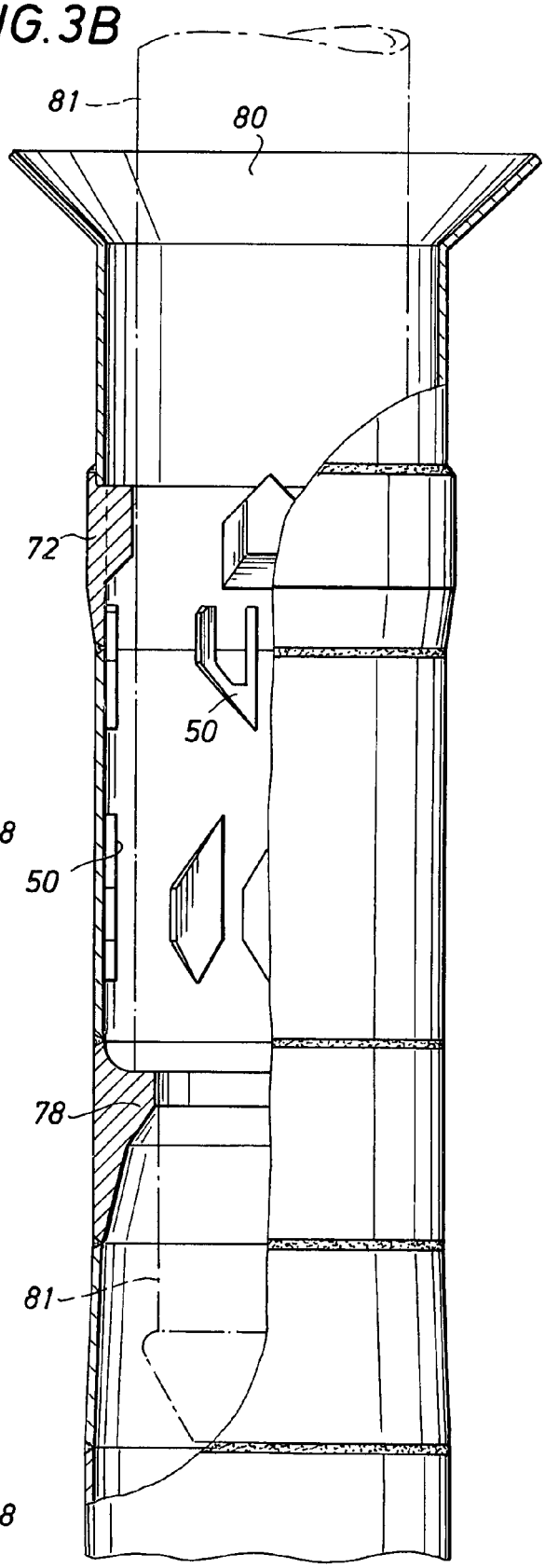
FIG. 3B is a partially cross-sectioned view of an embodiment of a pile having a tendon receptacle secured thereto in accordance with the present invention.

The embodiment illustrated in FIG. 3B is configured to accept an internally deployed underwater hammer, e.g. by using a follower 81. Funnel guide 80 will guide reception of the follower for the pile hammer for driving operations and later, the end of the tendon at a tendon anchor assembly. See FIG. 5. Returning to FIG. 3B, drive surface 78 is provided in the form of load shoulder 78B and is positioned below receptacle body 74. This allows the direct force of the hammer blows to travel through follower 81 to load shoulder 78B and bypass the tendon load connection. In this illustration, transition section 76 of tendon receptacle 18 bridges a significant difference in diameters between receptacle body 74 and elongated cylindrical member or pile member 28.

Figure 3C:
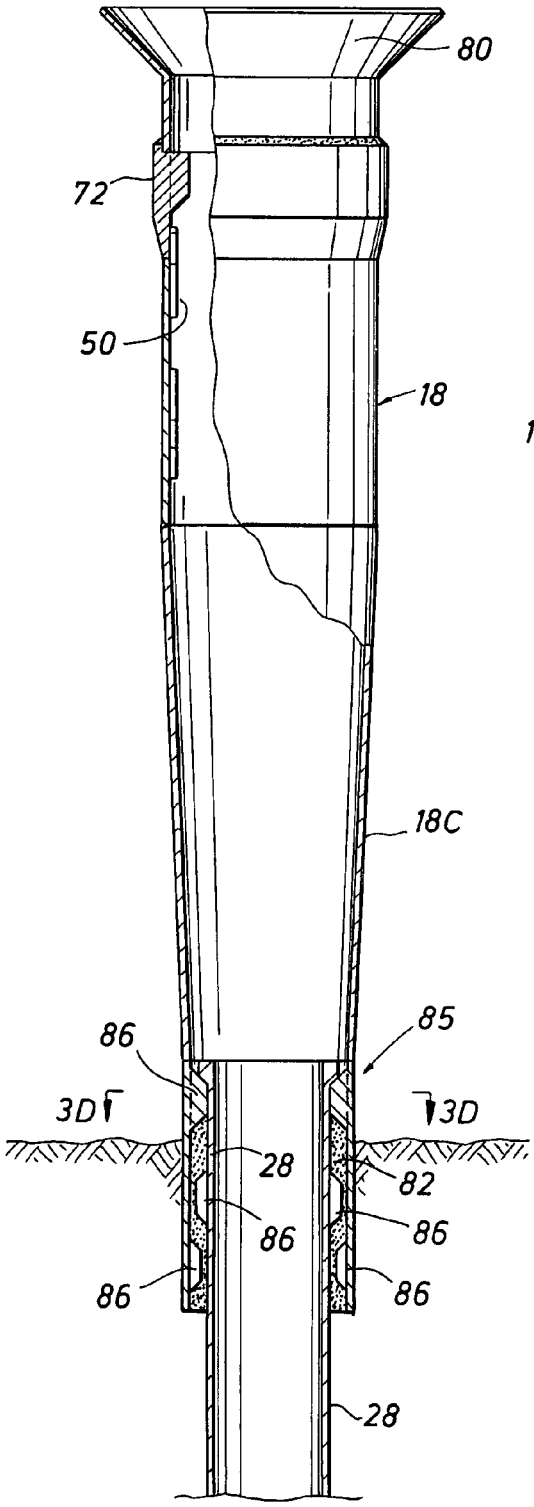
FIG. 3C is a partially cross-sectioned side view of a tendon receptacle formed within a pile extension in accordance with an alternate embodiment.
Figure 3D:
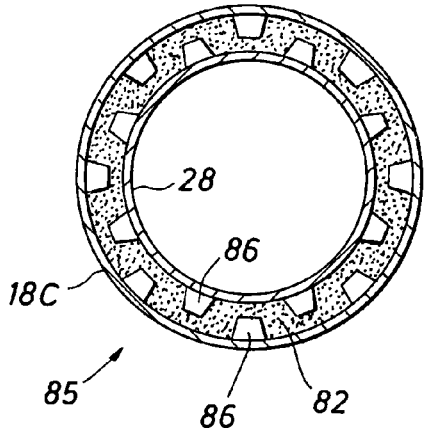
FIG. 3D is a cross sectional view taken along line 3D-3D of FIG. 3C.

FIG. 3C illustrates an embodiment in which piles are set by drill and grout operations and tendon receptacle 18 is provided as a pile extension 18C. Pile and grout operations use a jet assembly to start a borehole, then use drilling operations to complete the interval into which the pile is placed. Grout 83 is then injected into the annular space 82 between the pile and the borehole, e.g. by circulating down the borehole and returning up the annulus. Alternatively, the borehole may be filled with grout before the pile is inserted. The pile is secure after the grout sets. Those having ordinary skill in the art will appreciate that other bonding and setting agents may be used in place of conventional grout.

In this illustration, pile extension 18C telescopically engages the top of elongated cylindrical member 28, here pile member 28C. This sleeve or overlapping annular region 84 is grouted to secure a connection 85 of the pile extension to the elongated cylindrical member. Further, the structural integrity of the connection is enhanced by using a plurality of interspaced rails 86 projecting into the grouted overlapping annular space 84. See FIG. 3D.

Figure 3E:
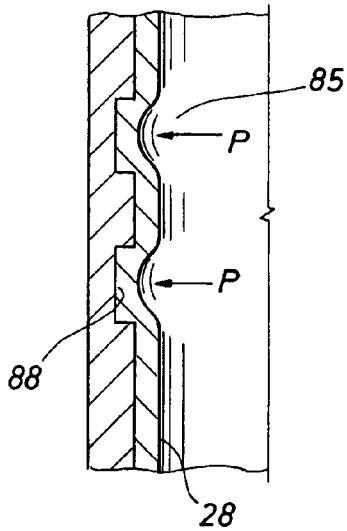
FIG. 3E is a cross sectional view of an alternate connection of a pile extension to a pile.

FIG. 3E illustrates another connection 85 of pile extension 18C to pile member 28. In this example the top of the pile member is swaged out into one or more annular rings 88 presented on the interior of the pile extension 18C. This swaging operation may be accomplished by packing off the inside of pile member 28 adjacent the annular rings and using hydraulic pressure denoted by arrow "p" or by mechanical swaging tools to cause the pile member to plasticly deform into ring 88.

Alternatively, the pile extension may be configured for reception within pile member 28 and connected through analogous grouting or swaging operations. Other methods for connecting a pile extension to a pile member either before or after the pile member has been installed are available to those having ordinary skill in the art who are provided with the teachings of the present disclosure. These may also vary depending upon whether the pile is driven or drilled and grouted.

The use of pile extensions also provides an opportunity for rehabilitating a pile having an integrally formed tendon receptacle that was damaged in installation. The damaged receptacle may be cut off, removed and replaced with a pile extension presenting a new tendon receptacle.

Figure 4:
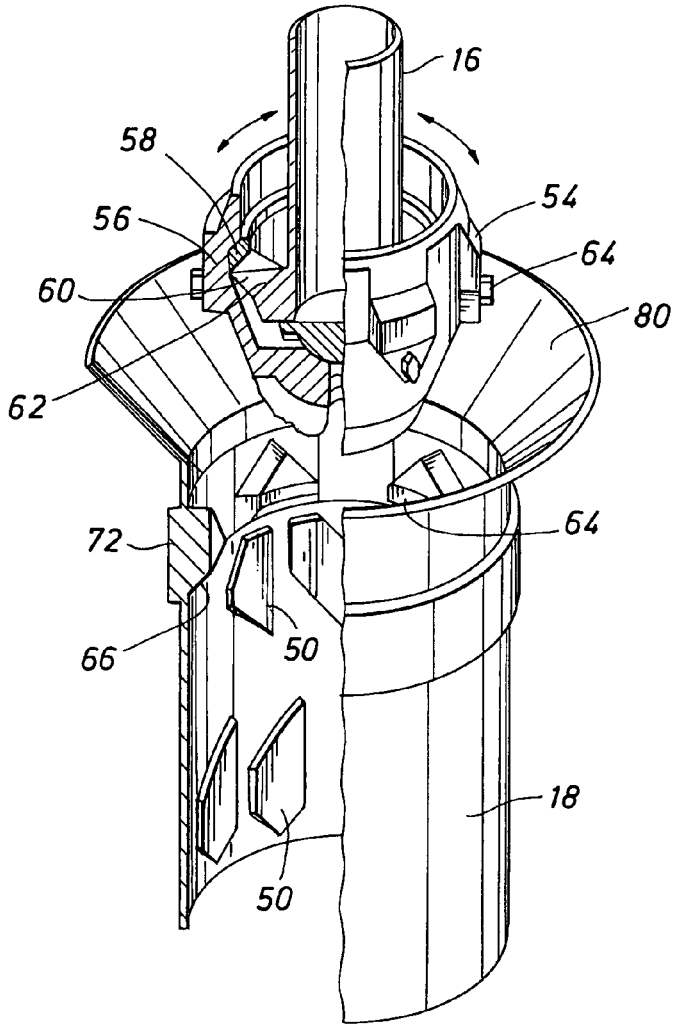
FIG. 4 is a partially cross sectioned view of a tendon about to engage a tendon receptacle.
Figure 5:
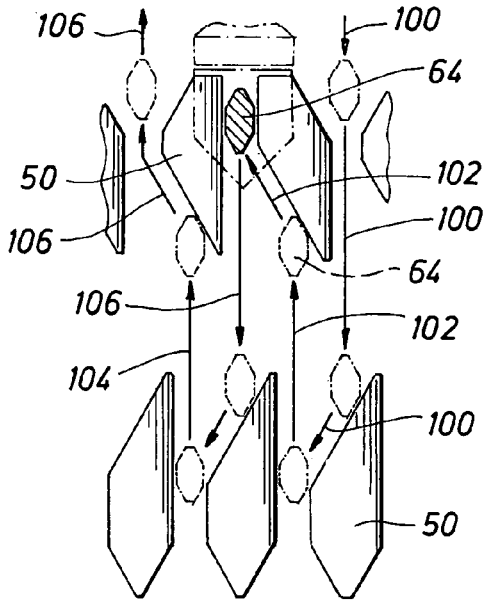
FIG. 5 is a planar representation of the guide surfaces presented annularly within the tendon receptacle of FIG. 4.

FIGS. 4 and 5 illustrate one system for connecting the bottom of tendon 16 to a tendon receptacle 18. Such a connection is disclosed in detail in U.S. Pat. No. 4,943,188, the disclosure of which is hereby fully incorporated and made a part hereof by reference. This type of connection uses guides 50 within tendon receptacle 18 to guide the rotation of rotating lug anchor connector 52.

In this embodiment, the lower extension of tendon 16 is provided with a rotating lug anchor connector 52. The anchor connector provides a plurality of spaced lugs 54 on a load ring 56. The load ring is allowed to rotate freely about retaining ring 58. A limited degree of freedom for pivotal rotation is provided in the connection between tendon 16 and tendon receptacle 18 in the embodiment of FIG. 4 by an elastomeric member 60 that connects retaining ring 58 to a load shoulder 62 on the base of tendon 16.

The latch sequence for connecting tendon 16 to the tendon receptacle 18 begins with lowering rotating lug anchor connector 52 into the tendon receptacle. Actuating lugs 64 carried on the anchor connector engage guides 50 within tendon receptacle 18. This initial stab-in causes a rotation of the rotating lug anchor connector 52 such that lugs 54 on load ring 56 pass between lugs 66 on load ring 72 within tendon receptacle 18.

FIG. 5 is an illustration of the path of one of actuation lugs 64 interacting with guides 50 in a figure that has been "flattened-out" to a planar view for simplification. The initial stab is illustrated by path 100. Pulling the tendon upward causes rotation of connector 52 as actuation lugs 64 travel a course illustrated as path 102. This brings lugs 54 into alignment with lugs 66 and securely engages anchor connector 52 of the tendon within tendon receptacle 18.

If necessary, this engagement may be released by a second down and up stroke on tendon 16. This course is illustrated by paths 104 and 106 which will rotate the lugs out of alignment and permit release of the tendon.

Figure 6:
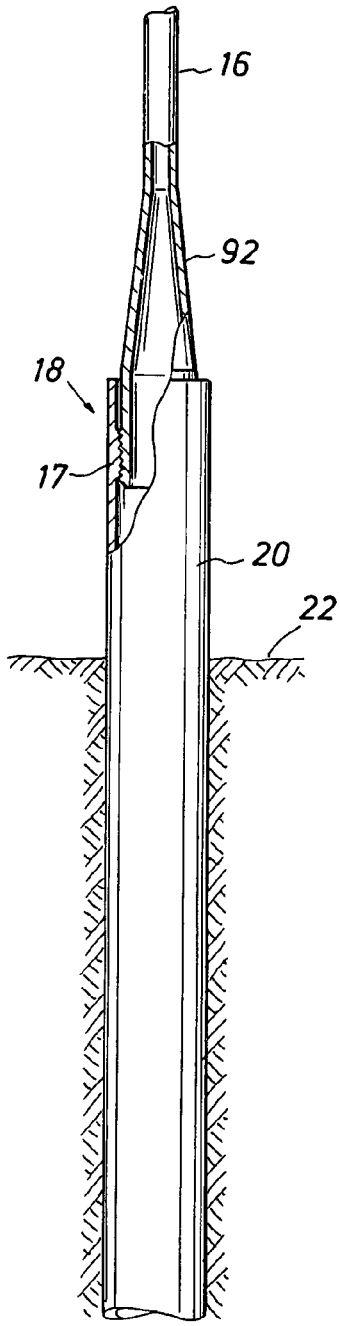
FIG. 6 is a partially cross-sectional view of another embodiment of a pile for practicing the present invention.

FIG. 6 illustrates another embodiment which provides for a rigid tendon anchor to tendon receptacle engagement at tendon load connection 17. In this illustration, tendon 16 terminates in a threaded tendon anchor 17A which threadingly engages tendon receptacle 18 in threaded region 17B below drive head 70 of pile 20. The necessary degree of freedom for rotation is accommodated by elastic flexure at stress joint 92 in pile 20. Alternatively, rigid tendon load connection 17 might by provided by one or more rotating lug rings on the bottom of a tendon without an elastomeric flex-element.

Other modifications, changes and substitutions are intended in the foregoing disclosure and in some instances some features will be employed without a corresponding use of other features. Accordingly, it is appropriate that the appended claims be construed broadly and in a manner consistent with the spirit and scope of the invention herein.

The invention claimed is:

1. A method of installing a foundation system on the ocean floor to accept tendons for a tension leg platform, comprising:

installing a plurality of pile members into an array of pile clusters through independent freestanding operations, wherein installing said plurality of pile members comprises, for each pile member:

lowering the pile member end first into contact with the ocean floor to setdown in a preselected position;

further lowering the pile member through a first interval at a controlled rate of self penetration advancing under the weight of the pile member, guided only by setdown and orientation controlled by rate of feed that does not exceed the rate of penetration in this first interval;

further lowering the pile member through a second interval of self penetration advancing under the weight of the pile member during which the pile is self-guiding; and driving the pile member through a third interval to a point at which the pile is secure for the design load; and providing a plurality of tendon receptacles, each presented on the top end of a pile member to concentrically receive a single tendon and providing a load path axially aligned with the pile member wherein providing the tendon receptacles comprises:

providing tendon receptacles formed integrally with pile members and with an interior load shoulder positioned below a tendon load connection;

and wherein driving the pile member comprises:

inserting an internal follower into the tendon receptacle and in contact with the internal load shoulder;

attaching an underwater hammer to the internal follower;

driving the pile member into the ocean floor by hydraulically driving the underwater hammer to strike the internal follower whereby the direct force of the hammer blows bypasses the tendon load connection.

2. A method for installing a foundation system on the ocean floor to accept tendons for a tension leg platform, comprising:

installing a plurality of pile members into an array of pile clusters through independent freestanding operations, wherein installing said plurality of pile members comprises, for each pile member:

lowering the pile member end first into contact with the ocean floor to setdown in a preselected position;

further lowering the pile member through a first interval at a controlled rate of self penetration advancing under the weight of the pile member, guided only by setdown and orientation controlled by rate of feed that does not exceed the rate of penetration in this first interval;

further lowering the pile member through a second interval of self penetration advancing under the weight of the pile member during which the pile is self-guiding; and driving the pile member through a third interval to a point at which the pile is secure for the design load; and providing a plurality of tendon receptacles, each presented on the top end of a pile member to concentrically receive a single tendon and providing a load path axially aligned with the pile member wherein providing said tendon receptacle comprises:

providing the tendon receptacle on a pile extension;

telescopically engaging a sleeve section of the pile extension to the top of the pile member; and securing the sleeve section of the pile extension to the pile member.

3. A method for installing a foundation system in accordance with claim 2 wherein securing the sleeve section of the pile extension comprises grouting the annular region between the sleeve section and the top of the pile member.

4. A method for installing a foundation system on the ocean floor for a tension leg platform, comprising:

lowering a pile member end first into contact with the ocean floor to setdown in a preselected position;

further lowering the pile member through a first interval at a controlled rate of self penetration advancing under the weight of the pile member, guided only by setdown and orientation controlled by a rate of feed that does not exceed the rate of penetration in this first interval;

further lowering the pile member through a second interval of self penetration advancing under the weight of the pile member during which the pile is self-guiding;

driving the pile member through a third interval to a point at which the pile is secure for the design load; and providing a tendon receptacle on the top of the pile member wherein providing the tendon receptacle comprises:

providing the tendon receptacle formed integrally with a pile member and with an interior load shoulder positioned below a tendon load connection;

and wherein driving a pile member comprises:

inserting an internal follower into the tendon receptacle and in contact with the interior load shoulder;

attaching an underwater hammer to the internal follower;

driving the pile member into the ocean floor by hydraulically driving the underwater hammer to strike the internal follower whereby the direct force of the hammer blows bypasses the tendon load connection.

5. A method for installing a foundation system on the ocean floor for a tension leg platform, comprising:

installing a plurality of pile members into an array of pile clusters through independent, freestanding operations, comprising, for each pile member:

lowering the pile member end first into contact with the ocean floor to setdown in a preselected position;

further lowering the pile member through a first interval at a controlled rate of self penetration advancing under the weight of the pile member, guided only by setdown and orientation controlled by a rate of feed that does not exceed the rate of penetration in this first interval;

further lowering the pile member through a second interval of self penetration advancing under the weight of the pile member during which the pile is self-guiding; and driving the pile member through a third interval to a point at which the pile is secure for the design load;

providing a plurality of tendon receptacle, each presented on the top end of a pile member and providing a load path axially aligned with the pile member;

wherein providing the tendon receptacles comprises:

providing tendon receptacles formed integrally with pile members and with an interior load shoulder positioned below a tendon load connection;

and wherein driving the pile member comprises:

inserting an internal follower into the tendon receptacle and in contact with the interior load shoulder;

attaching an underwater hammer to the internal follower;

driving the pile member into the ocean floor by hydraulically driving the underwater hammer to strike the internal follower whereby the direct force of the hammer blows bypasses the tendon load connection.

6. A method for installing a foundation system on the ocean floor for a tension leg platform, comprising:

lowering a pile member end first into contact with the ocean floor to setdown in a preselected position;

further lowering the pile member through a first interval at a controlled rate of self penetration advancing under the weight of the pile member, guided only by setdown and orientation controlled by a rate of feed that does not exceed the rate of penetration in this first interval;

further lowering the pile member through a second interval of self penetration advancing under the weight of the pile member during which the pile is self-guiding;

driving the pile member through a third interval to a point at which the pile is secure for the design load;

providing a tendon receptacle on the top of the pile member, comprising:

providing said tendon receptacle formed integrally with the pile member and with an interior load shoulder positioned below a tendon load connection;

and wherein driving the pile member comprises:

inserting an internal follower into the tendon receptacle and in contact with the interior load shoulder;

attaching an underwater hammer to the internal follower;

driving the pile member into the ocean floor by hydraulically driving the underwater hammer to strike the internal follower whereby the direct force of the hammer blows bypasses the tendon load connection.

7. A method of installing a foundation system on the ocean floor for a tension leg platform, comprising:

installing a plurality of pile members into an array of pile clusters through independent, freestanding operations, comprising, for each pile member:

lowering the pile member end first into contact with the ocean floor to setdown in a preselected position;

further lowering the pile member through a first interval at a controlled rate of self penetration advancing under the weight of the pile member, guided only by setdown and orientation controlled by a rate of feed that does not exceed the rate of penetration in this first interval;

further lowering the pile member through a second interval of self penetration advancing under the weight of the pile member during which the pile is self-guiding;

driving the pile member through a third interval to a point at which the pile is secure for the design load;

providing a plurality of tendon receptacles, each presented on the top end of a pile member and providing a load path axially aligned with the pile member, providing the tendon receptacles comprising:

providing tendon receptacles formed integrally with pile members and with an interior load shoulder positioned below a tendon load connection;

and wherein driving the pile member comprises:

inserting an internal follower into the tendon receptacle and in contact with the interior load shoulder;

attaching an underwater hammer to the internal follower;

driving the pile member into the ocean floor by hydraulically driving the underwater hammer to strike the internal follower whereby the direct force of the hammer blows bypasses the tendon load connection.

* * * * *